United States Patent [19]

Leisman et al.

[11] Patent Number: 4,681,186

[45] Date of Patent: Jul. 21, 1987

[54] ESCAPE CHUTE

[75] Inventors: Thomas Leisman, West Linn, Oreg.; Jon Huston, Denver, Colo.

[73] Assignee: Dynavac, Inc., Denver, Colo.

[21] Appl. No.: 787,258

[22] Filed: Oct. 15, 1985

Related U.S. Application Data

[63] Continuation-in-part of Ser. No. 660,344, Oct. 12, 1984, abandoned.

[51] Int. Cl.[4] ..... A62B 1/20

[52] U.S. Cl. ..... 182/47; 182/48

[58] Field of Search ..... 182/48, 49, 46, 47; 193/25 B, 25 R

[56] References Cited

U.S. PATENT DOCUMENTS

| | | | |
|---|---|---|---|
| 208,944 | 10/1878 | Wohlmann | 182/48 |
| 1,015,937 | 1/1912 | Brevetti et al. | 182/48 |
| 2,734,611 | 2/1956 | Gordon | 193/7 |
| 3,348,630 | 10/1967 | Yamamoto | 182/48 |
| 3,811,534 | 5/1969 | Fisher | 182/48 |
| 3,968,856 | 7/1976 | Keen et al. | 182/48 |
| 3,973,644 | 8/1976 | Zephinie | 182/47 |
| 3,977,495 | 8/1976 | Zephinie | 182/48 |
| 3,994,366 | 10/1976 | Okuma et al. | 182/48 |
| 4,005,762 | 2/1977 | Zephinie | 182/48 |
| 4,099,595 | 7/1978 | Tracy | 182/48 |
| 4,099,596 | 7/1978 | Tracy | 182/48 |
| 4,122,934 | 10/1978 | Nieto de Moreno | 193/32 |
| 4,162,717 | 7/1979 | Orii et al. | 182/48 |
| 4,164,990 | 8/1979 | Steifel et al. | 182/48 |
| 4,240,520 | 12/1980 | LaGrone et al. | 182/48 |
| 4,246,980 | 1/1981 | Miller | 182/48 |
| 4,339,019 | 7/1982 | Tracy | 182/47 |
| 4,398,621 | 8/1983 | Baker | 182/48 |
| 4,434,870 | 3/1984 | Fisher | 182/48 |
| 4,476,670 | 10/1984 | Ukai et al. | 56/328 |

FOREIGN PATENT DOCUMENTS 9947 of 1908 United Kingdom .

*Primary Examiner*—Reinaldo P. Machado
*Attorney, Agent, or Firm*—Arnold B. Silverman

[57] ABSTRACT

An escape device having a tubular escape chute with upper and lower ends. At least one zipper extends longitudinally at least along a portion of the chute in order to provide for entry into or exit out of the chute at different elevations. The chute has a friction-creating material which extends through a major portion of the chute's longitudinal extent thereby permitting an individual descending in the chute and contacting the panel to have his or her rate of descent retarded. The inner chute may have inner pleats resiliently maintained by an elastic member. The chute may consist of an inner tube and an outer tube.

18 Claims, 9 Drawing Figures

ESCAPE CHUTE

CROSS REFERENCE TO RELATED APPLICATION

This application is a continuation-in-part of U.S. Ser. No. 660,344, filed Oct. 12, 1984 and now abandoned.

BACKGROUND OF THE INVENTION

1. Field of the Invention

This invention relates to apparatus for escape during emergency situations and, more specifically, it relates to an improved chute through which individuals may escape.

2. Description of the Prior Art

It has been known to provide various means of emergency escape devices for use in buildings, on vessels at sea and for other locations where emergency evacuation may be required in order to prevent death and prevent or minimize injuries resulting from disasters such as fires, explosions or other situations making it desirable for individuals to be safely and rapidly evacuated.

U.S. Pat. Nos. 4,099,595; 4,099,596; and 4,339,010 disclose the use of chutes as escape devices. Disclosed are systems wherein these chutes contain discrete local braking elements which are adapted to retard the rate of descent of an individual employing the same. These disclosures also contain reference to a landing pad disposed at the bottom of the chute to facilitate the transition between generally vertically directed descent within the chute and discharge therefrom onto land. While these prior patents have represented advancements over the prior art, the present invention eliminates several features of these patents which limit the effectiveness of the same for certain uses. See also U.S. Pat. Nos. 4,164,990 and 4,246,980. The former discloses slide fasteners in evacuation apparatus.

U.S. Pat. Nos. 3,973,644; 3,977,495 and 4,005,762 disclose multiwalled chutes which are said to be elastic in a circumferential direction but not in a longitudinal direction.

U.S. Pat. No. 3,944,366 discloses a system having a cylindrical outer tube and a zig-zag inner tube with the latter being said to reduce the rate of descent.

U.S. Pat. No. 4,122,934 discloses an inflatable wall chute.

U.S. Pat. No. 4,122,934 discloses a chute having an elastomeric coating which is said to provide similar coefficients of friction in both wet and dry conditions. See also U.S. Pat. No. 4,434,870.

British Pat. No. 9,947 (1908) discloses a protective outer chute which houses a pad which in turn is secured to a cable.

These prior patents while disclosing tubes which are collapsible provide tubes which are a fixed length thereby necessitating cutting if evacuees are to be removed from a building, for example, at different elevations. Also, the local elastic strips adapted to provide braking action may produce injury to the user and may result in damage to the chute.

It will be appreciated, therefore, that there remains a need for an improved escape chute.

SUMMARY OF THE INVENTION

The present invention has met the above-described need.

A tubular escape chute has upper and lower ends and has zipper means extending generally longitudinally along at least a major portion of the chute. This permits exit from and egress into the chute at positions intermediate the upper and lower ends. In addition, the chute has a friction-creating panel disposed interiorly of and extending through a major portion of the chute's longitudinal extent. This permits an individual descending within the chute to have continuous frictional force applied to resist excessive rates of descent. The chute is preferably composed of a flexible material and has the friction-creating panel extending circumferentially less than the full circumference of the chute. More than one such friction-creating panel may be provided in order to cover different areas of the chute in local fashion, if desired.

In a preferred embodiment, the chute consists of an inner tube and an outer tube which are secured to each other. The inner tube may be composed of a material such as canvas and have the friction-creating panel secured thereto. In another embodiment, the inner tube material may be friction-creating and substitute for the friction-creating panel. The exterior material preferably is composed of or has a constituent which is heat reflective.

It is an object of the present invention to provide an improved escape device which will facilitate more efficient and safe egress of individuals from a building or other location.

It is a further object of the invention to provide such a system wherein entry into and discharge from the escape chute may be effected at various elevations.

It is another object of the present invention to provide for continuous friction-generating contact between the individual and the chute interior thereby more effectively controlling the rate of descent of the individual.

It is a further object of the present invention to provide such an escape chute which is economical to manufacture, durable and easy to use even by those unskilled in the use of the equipment.

These and other objects of the invention will be more fully understood from the following description of the invention on reference to the illustrations appended hereto.

DESCRIPTION OF THE PREFERRED EMBODIMENTS

Figure 1:
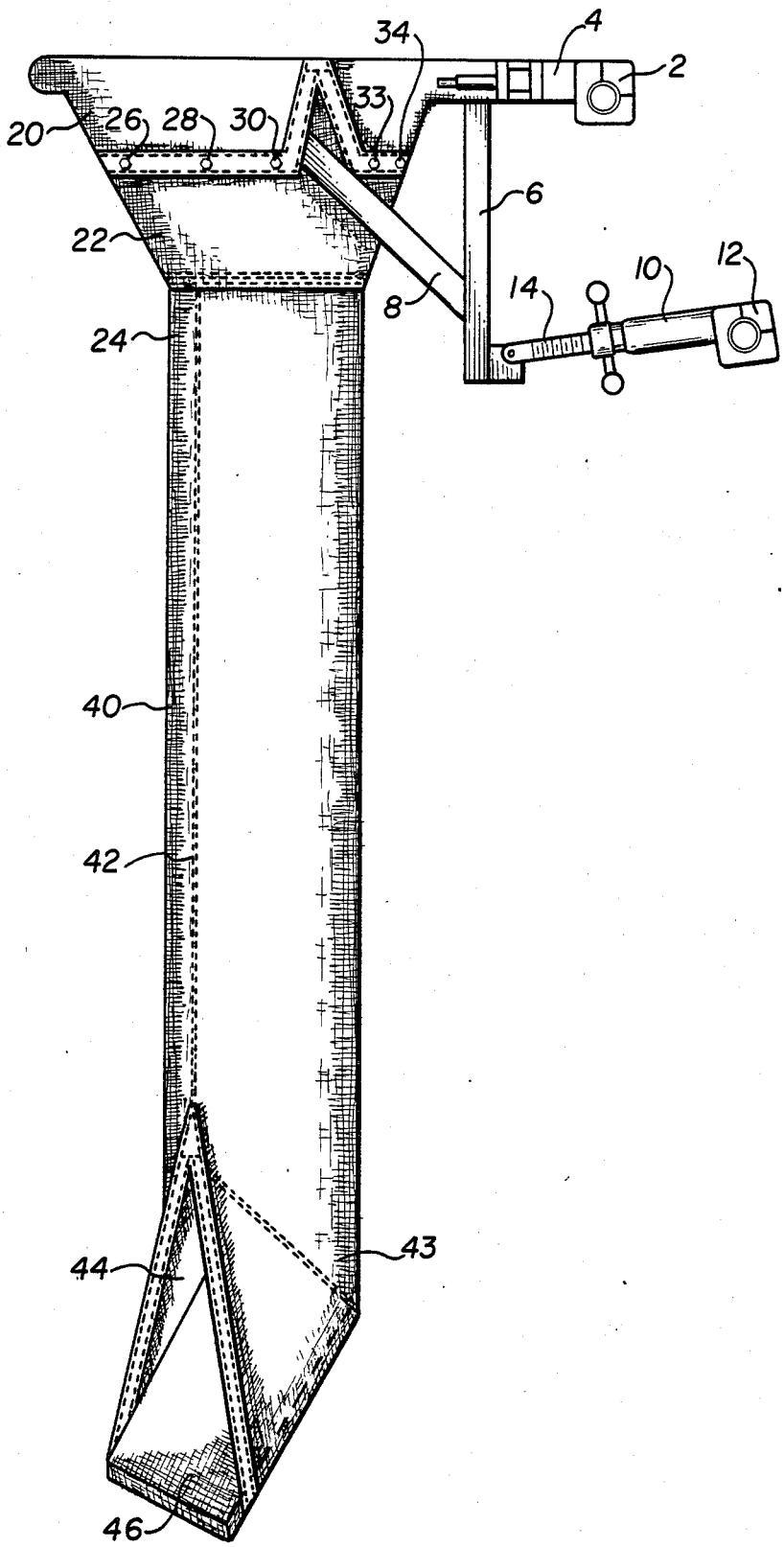
FIG. 1 is a partially schematic elevational view of a preferred form of apparatus of the present invention.

Referring now more specifically to FIG. 1 there is shown a preferred form of the apparatus of the present invention. In this embodiment, an upper support bracket has an anchoring member 2 with a projecting support member 4 and a depending support 6 to which are secured strap member 8 and support member 10 which is provided with anchor portion 12 and connector portion 14. By means of the openings and anchor members 2 and 12 the apparatus may be secured to a building or other structural member by any convenient means such as by a pipe or rod passing through the opening and being anchored by any desired means (not shown) to the structure. This support structure in turn supports the chute support 20 which is preferably substantially annular in shape. The conical portion 22 is secured to member 20 by mechanical fasteners such as nuts and bolts or grommets 26, 28, 30, 33, 34, for example. A depending tubular chute portion 40 has an upper end 24 and a lower end 43. The upper end 24 is secured by any desired means as by threaded connection or mechanical fasteners, for example, to the transition portion 22.

In a preferred embodiment of the invention in order to permit entry into the chute or egress therefrom at various elevations a longitudinally oriented zipper is provided in the wall of chute 40. This zipper means 42 which preferably is operable from either the inside of the tubular chute 40 or the exterior thereof and may also be operable either from the lower extremity or the upper extremity permits the chute to function as a variable height member thereby eliminating the problem of certain prior art devices wherein a fixed length chute was employed. The lower end of the chute 43 terminates in a slide 46 and an opening 44 out of which individuals descending within the chute may emerge.

Figure 2:
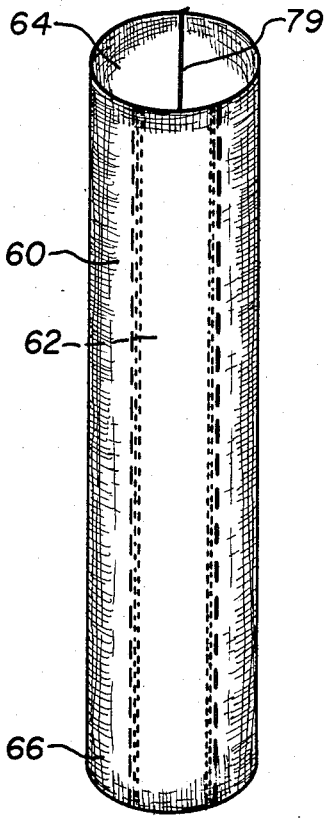
FIG. 2 is a perspective view of a form of inner tube employable in the present invention.
Figure 3:
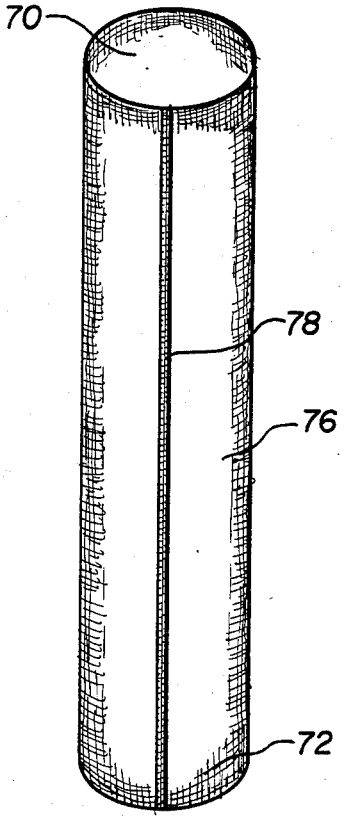
FIG. 3 is a perspective view of an outer tube employable in the present invention.

Referring to FIGS. 2 and 3 additional details of a preferred form of chute of the present invention will now be considered. In a preferred embodiment the chute 40 will be of tubular, generally cylindrical configuration and have an inner tubular member such as is shown in FIG. 2 and an outer tubular member such as is shown in FIG. 3 secured thereto. FIG. 2 illustrates a rear view of the inner chute 60 which has an upper end 64 and a lower end 66. The chute interior has a friction-creating panel 62 which serves to provide a continuous generally longitudinally oriented member to slow the rate of descent of an individual descending within the tube. This friction-creating panel 62 is preferably composed of a material which has a higher coefficient of friction than a remaining portion of inner tube 60. It also has a circumferential extent which is preferably less than the full circumference of the inner tube. If desired, one may employ two or more such panels and the expression, "friction-creating panel" as used herein shall be deemed to be generic to both single panels and multiple panels.

The panel 62 which is preferably substantially coextensive with the longitudinal extent of the inner tube 60 and has a minimum circumferential extent which is adequate to readily be engaged by an individual descending within the chute. While, if desired, the entire inner tube could be made of the material of which the friction-creating panel is made thereby eliminating the need for a separate panel secured to the inner tube, it is preferred to provide one or more inner tube friction-creating panels as separate members secured thereto. The opening provided by tube 60 is preferably sized so that a human being passing downwardly within the tube will contact the interior surfaces of the inner tube 60. If desired, a suitable friction enhancing coating material may be employed in lieu of or in addition to the panels.

FIG. 3 shows a view of the outer tube 76 which has an upper end 70 and a lower end 72 as viewed from a different diametric position than the view of the inner tube shown in FIG. 2. Zipper 78 would be aligned with a corresponding opening such as 79 in the inner tube 60 in a manner which will be described hereinafter.

In the preferred embodiment the inner tube 60 and outer tube 76 are fixedly secured to each other to function as a unit. The inner tube may be made of a material such as canvas, for example, with the friction-creating panel 62 being composed of a durable material having a higher coefficient of friction than canvas. It is preferred that the outer tube 76 be composed of a durable material which has a heat-reflecting characteristic. Among the preferred materials are aluminized materials. Such materials may be fabrics woven out of aluminum-containing fiber or may include solid webs of aluminum of a foil thickness, for example. It is desired that the composite chute be flexible and compressible both in a axial direction and in a transverse direction. The flexibility in the axial direction would permit storage in an axially compressed position, if desired, and flexibility in a transverse direction would permit yielding of the walls as an individual descends. It will be appreciated that the continuous internal panel 62 which may assume any angular circumferential extent as desired serves to eliminate the need for axially-spaced multiple resilient bumper members such as are shown in the prior art.

Figure 4:
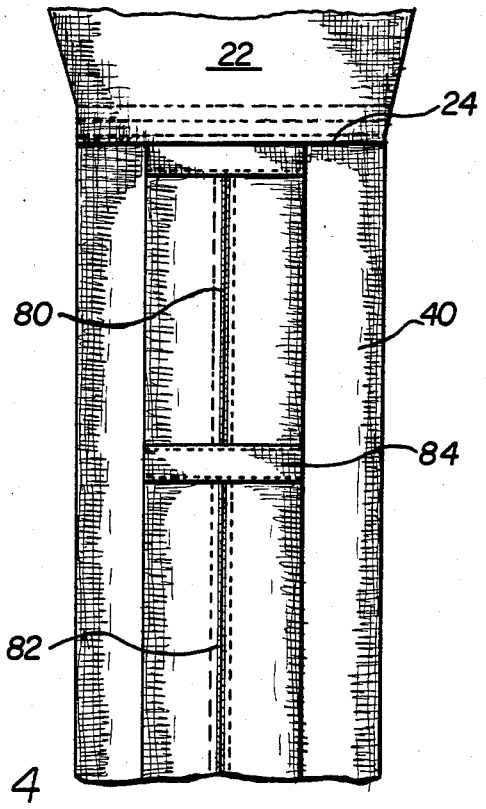
FIG. 4 is a fragmentary elevational view showing a modified form of the invention.

Referring now more specifically to FIG. 4 there is shown a further embodiment of the invention. In this embodiment of the invention, two separate zipper means are provided. An upper zipper 80 is provided within an upper section of the tube 40 and a lower zipper 82 which is preferably generally aligned with zipper 80 is provided within the lower portion of tube 40. A barrier member 84 which serves to separate the two zippers is provided. In this manner, the zippers may be operated independently of each other to create the capability of independently opening, closing or partially opening either zipper. If desired, additional zippers may be employed.

Figure 5:
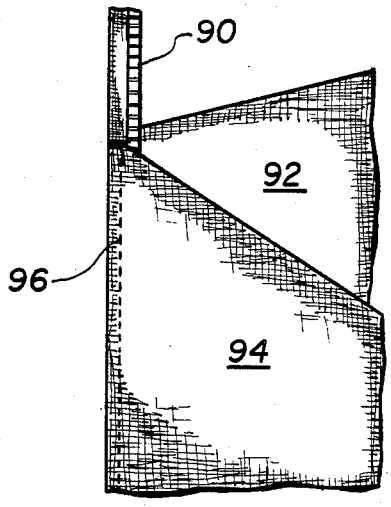
FIG. 5 is a partially schematic fragmentary view illustrating a means of securing a zipper to a two-walled chute of the present invention.
Figure 6:
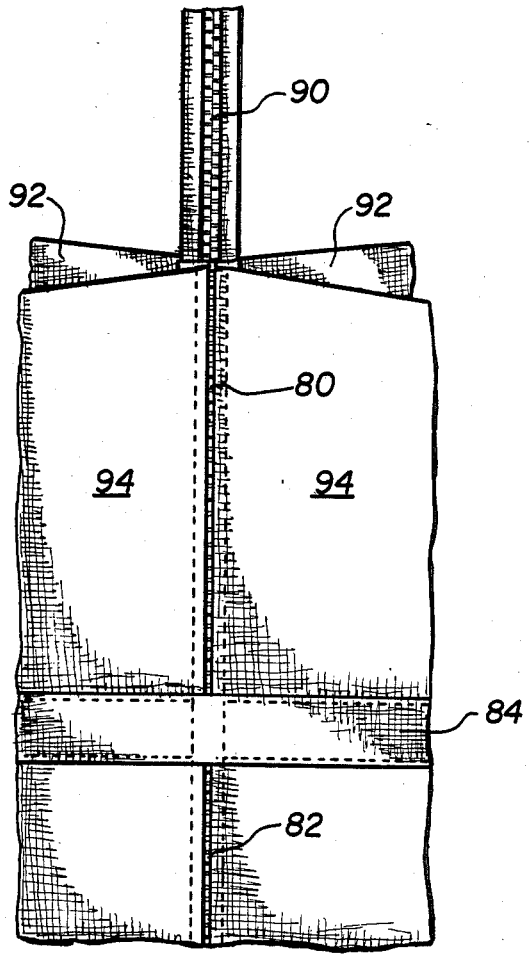
FIG. 6 is a perspective view, schematically illustrating securement of a zipper to the apparatus of the present invention.

Referring to FIG. 5 in greater detail there is shown a means by which a zipper 90 may be secured to an inner wall 92 and an outer wall 94 as by stitching 96. FIG. 6 shows a further refinement adopting the embodiment of FIG. 4 wherein the zipper 90 is secured to inner wall 92 and outer wall 94 by stitching. Barrier member 84 separates zipper 80 from 82.

Figure 7:
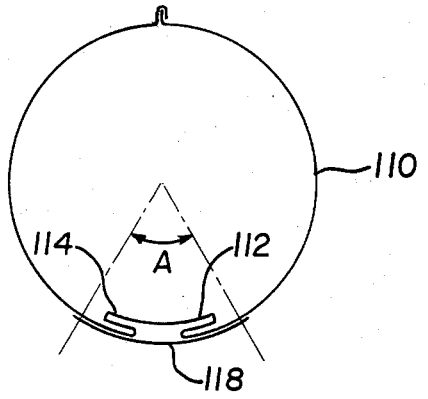
FIG. 7 is a schematic cross-sectional illustration of a modified form of the invention showing the inner tube in restricted position.
Figure 8:
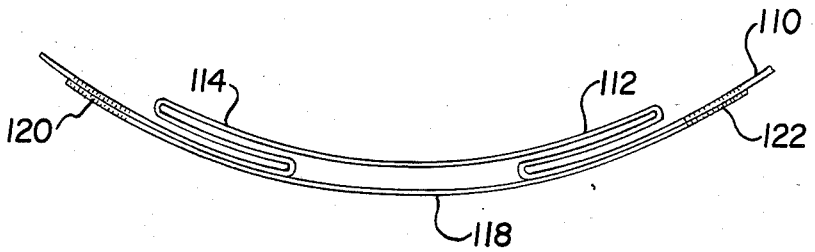
FIG. 8 is an enlarged illustration of a pleated portion of FIG. 7.
Figure 9:
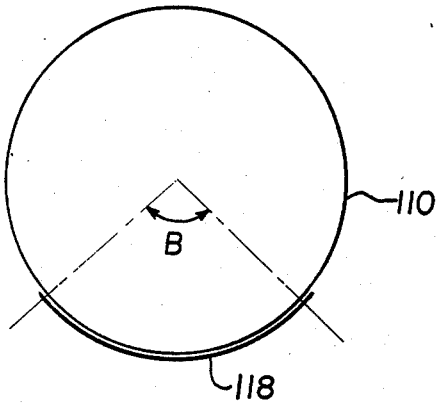
FIG. 9 is a schematic cross-sectional illustration of the structure of FIG. 7 in expanded position.

Referring to FIGS. 7 through 8, an alternate or supplemental means of retarding the rate of descent will be considered in addition to or in lieu of the friction creating panel or coating disclosed hereinbefore expansible portions may be provided. As in shown in these figures, the inner tube 110 which is preferably made of substantially nonexpanding material. The tube 110 is provided with pleats 112, 114, secured to inner tube 110 by any suitable means such as stitching at 120, 122, for example, is an elastic material 118. The inner tube 110 in unstretched condition is preferably of sufficiently small diameter as to be in intimate engagement with a person descending the chute. To the extent to which the person is larger than the opening, the elastic panel 118 will expand thereby causing expansion of the inner tube while remaining in intimate contact with the person. FIG. 9 shows the inner tube 110 with the pleats expanded against the resistance of the elastic material. This resilient effect will retard the rate of descent. The expanded elastic material cover an arc corresponding to angle B which is greater than angle A (FIG. 7).

The elastic material 118 and the pleats are preferably longitudinally coextensive with the chute, more than one elastic with associated pleats may be employed if desired. While various materials may be employed, examples of presently preferred materials will be provided. The inner tube may be composed of a suitable synthetic fabric such as nylon, for example. The material is preferably treated with a suitable fire retardant. A suitable material is that sold under the designation 500 Denier Condura with light K-Kote. A polyester elastic is a suitable material for the elastic strip. A suitable material for the outer tube is Gentex No. 1095 which is an aluminized spun Kevlar (duPont) Twill.

While for convenience for reference herein the term "zipper means" or "zipper" have been employed it will be appreciated that these terms are not to be construed as narrowly limited to the preferred mechanical type zippers, but would be applicable to other types of opening and closure systems wherein the circumferentially continuous wall of the chute may be opened completely or partially along one or more longitudinal lines.

It will be appreciated, therefore, that the present invention provides an improved form of escape device which is adapted to establish better control over the rate of descent of a descending individual and also is adapted to provide access at desired longitudinal positions of the chute for either ingress or egress of an individual. All of this is accomplished in an effective, economical and simple manner.

It will be appreciated that certain variations in the invention may be made without departing from the scope thereof. For example, one need not secure the upper extremity by means of the specifically illustrated form. Also, if desired the lower slide 46 may be eliminated entirely or a modified form of slide may be employed. While the apparatus is advantageous for use with persons, it will be appreciated that it may also be used for animals or property.

Whereas particular embodiments of the invention have been described above for purposes of illustration it will be appreciated by those skilled in the art that numerous variations of the details may be made without departing from the invention as described in the appended claims.

We claim:

1. An escape device comprising a tubular escape chute having:

an upper end and a lower end, zipper means extending generally longitudinally along at least a portion of said chute, and a friction-creating panel which extends over a major portion of the chute's longitudinal length, circumferentially less than the full circumference of the chute, and generally continuously from a portion generally adjacent to said upper end of said tubular escape chute to a portion generally adjacent to said lower end of said tubular escape chute, whereby entry into said chute or egress therefrom may be accomplished intermediate the upper end and lower end, and an individual descending in said chute and contacting said panel will have his or her rate of descent retarded.

2. The escape device of claim 1 including said tubular escape chute having an inner tube and an outer tube secured to said inner tube.

3. The escape device of claim 2 including said friction-creating panels secured to the inner surface of said inner tube.

4. The escape device of claim 3 including said outer tube being composed at least in part of a heat-reflecting material.

5. The escape device of claim 4 including said outer tube being aluminized.

6. The escape device of claim 1 including said zipper means having at least two zippers.

7. The escape device of claim 6 including said zippers disposed within different longitudinal sections of said tubular escape chute.

8. The escape device of claim 7 including said zippers being generally aligned with each other.

9. The escape device of claim 1 including said tubular escape chute being flexible.

10. The escape device of claim 4 including said inner tube being composed of canvas and said outer tube containing aluminum.

11. An escape device comprising an elongated escape chute body having an inner tube, said inner tube having an elongated pleated zone, and an elastic material secured to said pleated zone for resisting opening of said pleats, whereby an individual passing through said chute will be in intimate resiliently maintained contact with said inner tube.

12. The escape device of claim 11 including said pleated zone and said elastic material covering a portion of the circumferential extent of said inner tube.

13. The escape device of claim 12 including said pleated zone being longitudinally substantially coextensive with said inner tube.

14. The escape device of claim 13 including said elastic material being longitudinally substantially coextensive with said inner tube.

15. The escape device of claim 14 including zipper means extending generally longitudinally along at least a portion of said chute, whereby entry into said chute or egress therefrom may be accomplished intermediate the upper end and lower end of such chute.

16. The escape device of claim 15 including said chute having an inner tube and an outer tube.

17. The escape device of claim 15 including friction-creating material extending over a major portion of said inner tube is longitudinal extent.

18. The escape device of claim 17 including said friction creating material being at least one friction-creating panel.

* * * * *